US008308228B2

(12) United States Patent
Lawson et al.

(10) Patent No.: US 8,308,228 B2
(45) Date of Patent: Nov. 13, 2012

(54) ZERO-WALL CLEARANCE LINKAGE MECHANISM FOR A LIFTING RECLINER

(75) Inventors: Gregory M. Lawson, Tupelo, MS (US); Jason Allan Bryant, Fulton, MS (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 12/981,185

(22) Filed: Dec. 29, 2010

(65) Prior Publication Data

US 2011/0193373 A1 Aug. 11, 2011

Related U.S. Application Data

(60) Provisional application No. 61/303,666, filed on Feb. 11, 2010.

(51) Int. Cl.
*A47C 1/02* (2006.01)

(52) U.S. Cl. ..... 297/85; 297/330; 297/331; 297/335; 297/DIG. 10

(58) Field of Classification Search ..... 297/330, 297/69, 83–86, 331, 335, 452.38, DIG. 10
See application file for complete search history.

(56) References Cited

U.S. PATENT DOCUMENTS

| | | | | |
|---|---|---|---|---|
| 4,083,599 | A * | 4/1978 | Gaffney | 297/131 |
| 5,076,644 | A | 12/1991 | Northcutt | |
| 5,265,935 | A | 11/1993 | Geisler et al. | |
| 5,312,153 | A * | 5/1994 | Lin | 297/89 |
| 5,466,046 | A * | 11/1995 | Komorowski et al. | 297/325 |
| 5,730,494 | A * | 3/1998 | LaPointe et al. | 297/330 |
| 6,840,575 | B2 * | 1/2005 | Hesse | 297/85 M |
| 7,575,279 | B2 * | 8/2009 | Robertson | 297/330 |
| 7,631,937 | B2 * | 12/2009 | Robertson | 297/330 |
| 7,766,421 | B2 * | 8/2010 | Lawson | 297/85 R |
| 2001/0035668 | A1 | 11/2001 | Gaffney et al. | |
| 2008/0150329 | A1 | 6/2008 | Lawson | |

FOREIGN PATENT DOCUMENTS

EP 2368458 A1 9/2011

OTHER PUBLICATIONS

International Searching Authority, Patent Cooperation Treaty Search, International Application No. PCT/US2011/024211 mailed on Apr. 6, 2011, 13 pages.
Notification of Transmittal of International Preliminary Report on Patentability in PCT/US11/24211 mailed Mar. 5, 2012, 4 pages.

* cited by examiner

*Primary Examiner* — Laurie Cranmer
(74) *Attorney, Agent, or Firm* — Shook Hardy & Bacon LLP

(57) ABSTRACT

A seating unit that includes a linkage mechanism adapted to move the seating unit between seat-lift, closed, extended, reclined, and seat-lift positions is provided. The linkage mechanism includes a seat-mounting plate mounted to a footrest assembly, a base plate fixedly mounted to a lift assembly, a back-mounting link rotatably coupled to the seat-mounting plate, a seat-adjustment assembly with a bellcrank, and a linear actuator for automating adjustment of the linkage mechanism. In operation, a stroke in a first phase of the linear actuator generates a force on the bellcrank that translates the seat-mounting plate rearward in a consistent angle of inclination and rotates the back-mounting link from a reclined to an upright orientation. A stroke in a second phase acts to collapse the footrest assembly. A stroke in a third phase causes the lift assembly to raise and tilt the seating unit, thereby accommodating egress and ingress of an occupant.

17 Claims, 10 Drawing Sheets

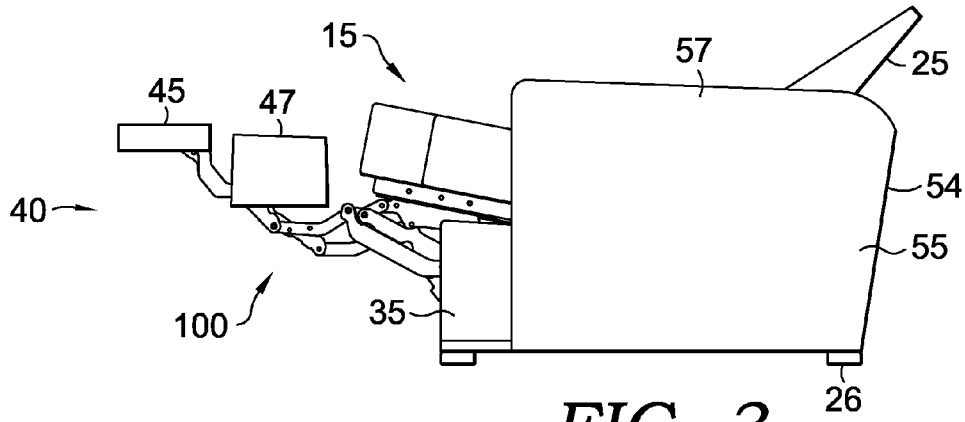
FIG. 3.
FIG. 4.
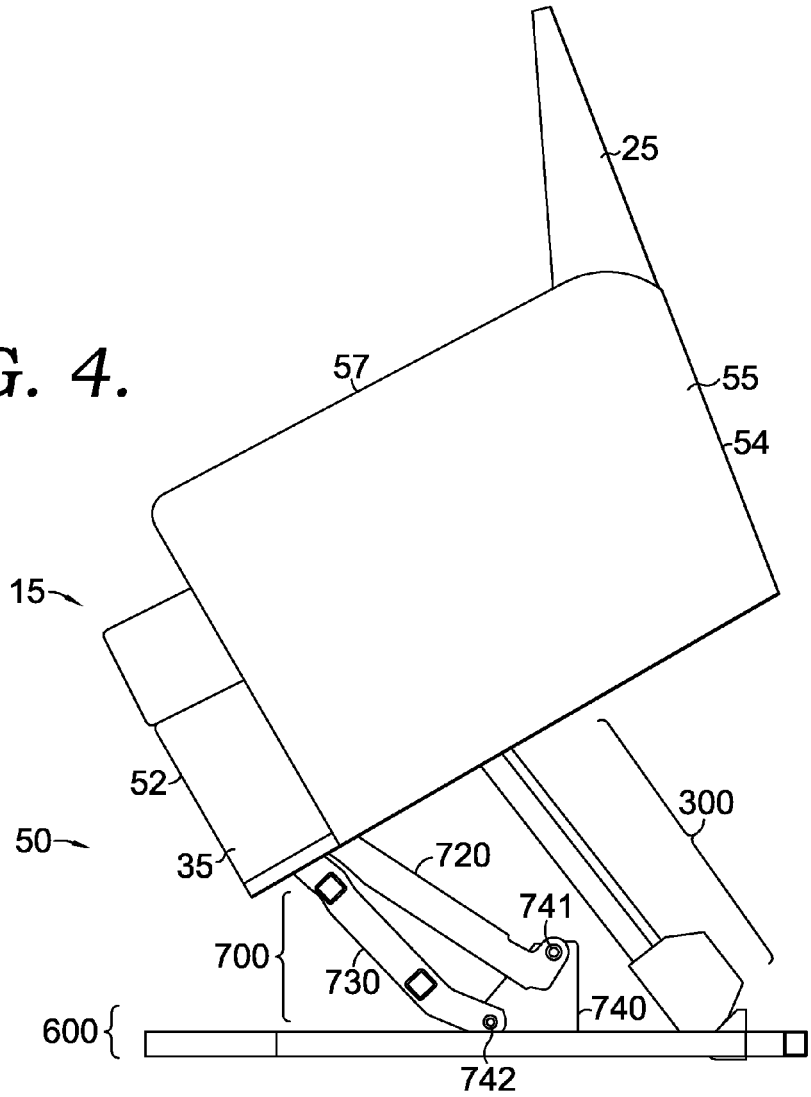

ZERO-WALL CLEARANCE LINKAGE MECHANISM FOR A LIFTING RECLINER

CROSS-REFERENCE TO RELATED APPLICATIONS

This application claims the benefit of U.S. Provisional Application No. 61/303,666, filed Feb. 11, 2010, entitled "ZERO-WALL CLEARANCE LINKAGE MECHANISM FOR A LIFTING RECLINER," herein incorporated by reference.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit, which is otherwise limited by the configurations of linkage mechanisms in the field. Additionally, the improved linkage mechanism of the present invention provides for reclining a seating unit that is positioned against a wall or placed within close proximity of other fixed objects.

Reclining and lifting seating units exist that allow a user to forwardly extend a footrest, to recline a backrest rearward relative to a seat, and to lift the seat for easy ingress and egress thereof. These existing seating units typically provide three basic positions (e.g., a standard, non-reclined closed position; an extended position; and a reclined position), and a seat-lift position as well. In the closed position, the seat resides in a generally horizontal orientation and the backrest is disposed substantially upright. Additionally, if the seating unit includes an ottoman attached with a mechanical arrangement, the mechanical arrangement is collapsed such that the ottoman is not extended. In the extended position, often referred to as a television ("TV") position, the ottoman is extended forward of the seat, and the backrest remains sufficiently upright to permit comfortable television viewing by an occupant of the seating unit. In the reclined position the backrest is pivoted rearward from the extended position into an obtuse relationship with the seat for lounging or sleeping. In the seat-lift position, the recliner mechanism is typically adjusted to the closed position and a lift assembly raises and tilts forward the seating unit in order facilitate entry thereto and exit therefrom.

Several modern seating units in the industry are adapted to provide the adjustment capability described above. However, these seating units require relatively complex linkage mechanisms to afford this capability. The complex linkage assemblies limit certain design aspects when incorporating automation. In particular, the geometry of these linkage assemblies impose constraints on incorporating or mounting a single motor thereto. Such constraints include the motor, during extension and/or retraction when adjusting between the positions mentioned above, interfering with crossbeams, the underlying surface, or moving parts attached to the linkage assembly. Accordingly, two or more motors with substantially extensive strokes are generally required to accomplish automating a full range of motion of a lifter-recliner seating unit. As such, a more refined linkage mechanism that achieves full movement when being automatically adjusted between the closed, extended, reclined, and even seat-lift positions would fill a void in the current field of motion-upholstery technology.

Further, motorized adjustment of the conventional complex linkage mechanisms often causes the ottoman(s) and the backrest of the seating unit to move out of sequence. For example, when adjusting from the closed position to the extended position, a pressure generated by the occupant's legs on the ottoman(s) may cause resistance in extending the footrest assembly. As a result of the resistance, the motorized adjustment may commence reclining the backrest out of sequence until full travel of a predefined stroke is attained. Accordingly, embodiments of the present invention pertain to a novel linkage mechanism that is constructed in a simple and refined arrangement in order to provide suitable function while overcoming the above-described, undesirable features inherent within the conventional complex linkage mechanisms.

BRIEF SUMMARY OF THE INVENTION

Embodiments of the present invention seek to provide a simplified lifter-recliner linkage mechanism that can be assembled to a single compact motor and that can be adapted to essentially any style of seating unit. In an exemplary embodiment, the compact motor in concert with the linkage mechanism can achieve full movement and sequenced adjustment of the seating unit when being automatically adjusted between the closed, extended, reclined, and seat-lift positions. The compact motor may be employed in a proficient and cost-effective manner to adjust the linkage mechanism without creating interference or other disadvantages appearing in the conventional designs that are inherent with automation thereof. The linkage mechanism may be configured with features that assist in sequencing the seating-unit adjustment between positions, translating a seat in a substantially consistent inclination angle during the seating-unit adjustment, and curing other disadvantages appearing in the conventional designs.

Generally, the lifter-recliner seating unit includes the following components: foot-support ottoman(s); a pair of base plates in substantially parallel-spaced relation; a pair of lift assemblies and at least one crossbeam spanning the lift assemblies; a support assembly for coupling the lift assemblies; a pair of seat-mounting plates in substantially parallel-spaced relation; and a pair of the generally minor-image linkage mechanisms that interconnect the base plates to the seat-mounting plates. In operation, the linkage mechanisms are adapted to move between a seat-lift position, a closed position, an extended position, and a reclined position, while the lift assemblies are adapted to move the linkage mechanisms into and out of a seat-lift position.

In one embodiment, the linkage mechanisms include a pair of footrest assemblies that movably interconnect the foot-support ottoman(s) to the seat-mounting plates. In instances, the linkage mechanisms each include a seat-adjustment assembly with a rear bellcrank that is adapted to translate the respective seat-mounting plates over the base plates during adjustment between the closed position, the extended position, and the reclined position. In one embodiment, a rear bellcrank is provided to translate the seat-mounting plates forward and rearward, when adjusting between these positions, while consistently maintaining the seat-mounting plates' inclined orientation relationship to the base plates. As such, in this embodiment, a surface of the seat of the seating unit is maintained at a particular inclination angle throughout adjustment.

In another embodiment, each of the linkage mechanisms includes a sequence plate and a sequence element. The sequence plate includes a guide slot that is configured with a first region, a second region, and an intermediate region that interconnects the first region and the second region. The sequence element generally extends into the guide slot. In operation, the sequence element resides within the first region when the seating unit is adjusted to the reclined position, within the intermediate region when the seating unit is adjusted to the extended position, and within the second region when the seating unit is adjusted to the closed position. Generally, interaction of the sequence element with walls of the guide slot resists adjustment of the linkage mechanisms directly between the closed and reclined positions. For example, when moving from the closed position to the extended position, the backrest is restrained from inadvertently reclining. In another example, when moving from the reclined position to the extended position, the footrest assembly is restrained from inadvertently extending.

In yet another embodiment, the seating unit includes a linear actuator that provides automated adjustment of the linkage mechanisms between the closed position, the extended position, the reclined position, and the seat-lift position. Generally, the linear-actuator adjustment is sequenced into a first phase, a second phase, and a third phase that are mutually exclusive in stroke. In one instance, the first phase moves the footrest assembly between the reclined position and the extended position, the second phase moves the seat-adjustment assembly between the extended position and the closed position, and the third phase moves the pair of lift assemblies into and out of the seat-lift position, while maintaining the linkage mechanisms in the closed position.

In an exemplary embodiment, the linear actuator includes the following components: a motor mechanism; a track operably coupled to the motor mechanism; and a motor activator block that translates longitudinally along the track under automated control. In instances, the track includes a first travel section, a second travel section, and a third travel section. In operation, during the first phase, the motor activator block longitudinally translates along the first travel section, thereby creating a lateral thrust at a motor swing bracket, which is rotatably coupled to a link of a respective lift assembly. This longitudinal translation within the first travel section invokes first-phase movement of the motor swing bracket that controls adjustment of the seat-adjustment assembly between the reclined position and the extended position.

During the second phase, the motor activator block longitudinally translates along the second travel section, thereby creating another lateral thrust at the motor swing bracket. This longitudinal translation within the second travel section invokes second-phase movement of the motor swing bracket that controls adjustment of the footrest assembly between the closed position and the extended position. Typically, the first-phase movement includes a range of degrees of angular rotation that does not intersect a range of degrees included within the second-phase of movement.

Last, during the third phase, the motor activator block longitudinally translates along the third travel section, thereby creating a lateral thrust at the motor swing bracket. Because, at this point, the motor swing bracket is prevented from further movement as a result of a detent condition of the linkage mechanism in the closed position, this longitudinal translation within the third travel section invokes adjustment of the lift assemblies into or out of the seat-lift position, while maintaining the linkage mechanisms in the closed position. As such, embodiments of the present invention introduce a single linear actuator that is configured to controllably adjust the linkage mechanisms of a seating between the four positions above in a sequential or continuous manner.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views:

FIG. 3 is a view similar to FIG. 1, but in a reclined position, in accordance with an embodiment of the present invention;

FIG. 4 is a view similar to FIG. 1, but in a seat-lift position, in accordance with an embodiment of the present invention;

DETAILED DESCRIPTION OF THE INVENTION

Figure 1:
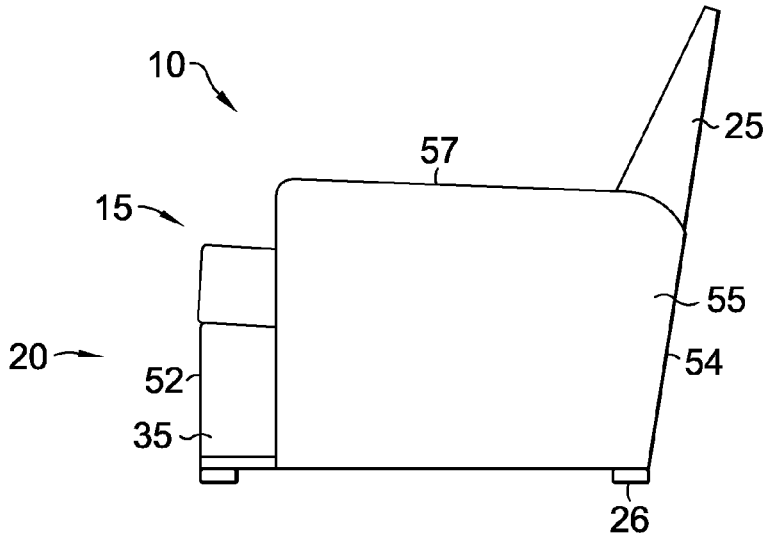
FIG. 1 is a diagrammatic lateral view of a seating unit in a closed position, in accordance with an embodiment of the present invention.

FIGS. 1-4 illustrate a seating unit 10. Seating unit 10 has a seat 15, a backrest 25, legs 26 (e.g., support bushings or a support assembly 600 that rests upon an underlying surface), at least one linkage mechanism 100, at least one lift assembly 700, a motor assembly 300, a first foot-support ottoman 45, a second foot-support ottoman 47, a stationary base 35, and a pair of opposed arms 55. Stationary base 35 has a forward section 52, a rearward section 54, and is supported by the legs 26 or the support assembly 600 (see FIG. 4), which vertically suspends the stationary base 35 above the underlying surface (not shown). In addition, the stationary base 35 is interconnected to the seat 15 via the linkage mechanism(s) 100 that are generally disposed between the pair of opposed arms 55, and the rearward section 54. Seat 15 is moveable over the stationary base 35 during adjustment of the seating unit 10, or when raising or lowering the seating unit 10 into or out of a seat-lift position (see FIG. 4). In embodiments, the seat 15 and/or the backrest 25 is moveable according to the arrangement of the linkage mechanism 100 such that interference between the seat 15/backrest 25 and the opposed arms 55 is prevented throughout adjustment.

Opposed arms 55 are laterally spaced and have an arm-support surface 57 that is typically substantially horizontal. In one embodiment, the pair of opposed arms 55 are attached to the stationary base 35 via intervening members. The backrest 25 extends from the rearward section 54 of the stationary base 35 and is rotatably coupled to the linkage mechanism(s) 100, typically proximate to the arm-support surface 57. First foot-support ottoman 45 and the second foot-support ottoman 47 are moveably supported by the linkage mechanism(s) 100. The linkage mechanism(s) 100 are arranged to articulably actuate and control movement of the seat 15, the back 25, and the ottomans 45 and 47 between the positions shown in FIGS. 1-3, as more fully described below. In addition, when the linkage mechanism 100 is adjusted to the closed position (see FIG. 3), the lift assembly 700 is configured to adjust the seating unit 10 into and out of the seat-lift position (see FIG. 4).

As shown in FIGS. 1-4, the seating unit 10 is adjustable to four positions: a closed position 20, an extended position 30 (i.e., TV position), the reclined position 40, and the seat-lift position 50. FIG. 1 depicts the seating unit 10 adjusted to the closed position 20, which is a normal non-reclined sitting position with the seat 15 in a generally horizontal position and the backrest 25 generally upright and generally perpendicular to the seat 15. In one embodiment, the seat 15 is disposed in a slightly inclined orientation relative to the stationary base 35. In this embodiment, the inclined orientation may be maintained throughout adjustment of the seating unit 10 due to the novel configuration of the linkage mechanism(s) 100. Further, when adjusted to the closed position 20, the ottomans 45 and 47 are positioned below the seat 15.

Figure 2:
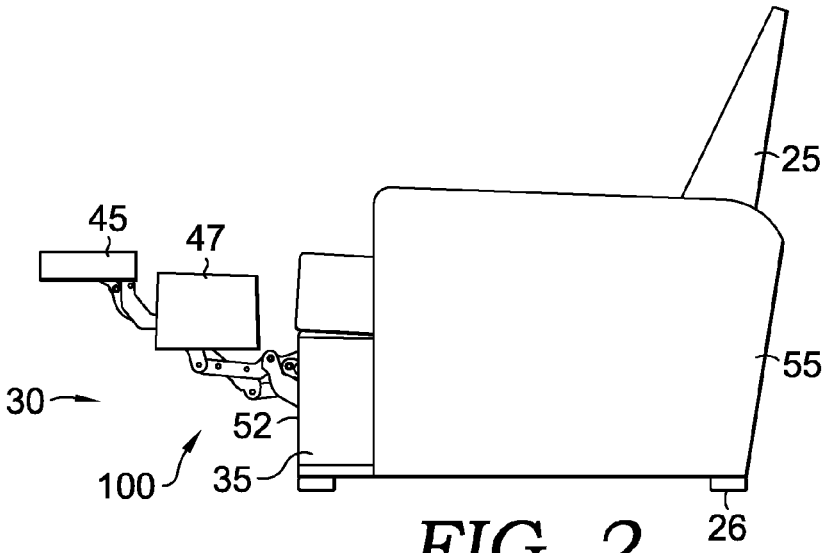
FIG. 2 is a view similar to FIG. 1, but in an extended position, in accordance with an embodiment of the present invention.

Turning to FIG. 2, the extended position 30, or TV position, will now be described. When the seating unit 10 is adjusted to the extended position 30, the first foot-support ottoman 45 and the second foot-support ottoman 47 are extended forward of the forward section 52 of the stationary base 35 and disposed in a generally horizontal orientation. However, the backrest 25 remains substantially perpendicular to the seat 15 and will not encroach an adjacent wall. Also, the seat 15 is maintained in the inclined orientation relative to the stationary base 35. Typically, the seat 15 is translated slightly forward and upward relative stationary base 35. Thus, the configuration of the seating unit 10 in the extended position 30 provides an occupant an inclined TV position while providing space-saving utility. This independent movement of the seat 15, with respect to the opposed arms 55, allows for a variety of styling to be incorporated into the seat 15, such as T-cushion styling.

FIG. 3 depicts the reclined position 40, in which the seating unit 10 is fully reclined. Typically, the backrest 25 is rotated rearward by the linkage mechanism 100 and biased in a rearward inclination angle. The rearward inclination angle is typically an obtuse angle in relation to the seat 15. However, the rearward inclination angle of the backrest 25 is offset by a forward and upward translation of the seat 15 as controlled by the linkage mechanism 100. This is in contrast to other reclining chairs with 3- or 4-position mechanisms, which cause their backrest to move rearward during adjustment, thereby requiring that the reclining chair be positioned a considerable distance from an adjacent rear wall or other proximate fixed objects. Thus, the forward and upward translation of the seat 15 in embodiments of the present invention allow for zero-wall clearance. Generally, the "zero-wall clearance" is utilized herein to refer to a space-saving utility that permits positioning the seating unit 10 in close proximity to an adjacent rear wall and other fixed objects behind the seating unit. In embodiments of the reclined position 40, the ottomans 45 and 47 may be moved farther forward and upward from their position in the extended position 30.

Turning to FIG. 4, the seat-lift position 50, will now be described. When the seating unit 10 is adjusted to the seat-lift position 50, the linkage mechanism(s) 100 are maintained in the closed position 20 of FIG. 1, but raised upward and tilted forward to assist with ingress and egress of the seating unit 10. In an exemplary embodiment, the lift assemblies 700 are employed to raise and tilt the linkage mechanism(s) 100, as well as the seating-unit components attached thereto, with respect to the support assembly 600. In one instance, adjustment of the lift assembly 700 may be automated through use of the linear actuator within the motor assembly 300. Typically, the linear actuator is utilized to adjust the linkage mechanism 100 between the closed, extended, and reclined positions as well.

Turning to FIGS. 5-13, exemplary configurations of a linkage mechanism 100 for a lifter-recliner-type seating unit 10 (hereinafter "lifter recliner) that is powered by a linear actuator included within the motor assembly 300 are illustrate and will now be discussed. With initial reference to FIG. 5, a perspective view of the linkage mechanism 100 in the reclined position is shown, in accordance with an embodiment of the present invention. In embodiments, the linkage mechanism 100 includes a footrest assembly 200, a seat-mounting plate 400, a base plate 410, and a seat-adjustment assembly 500. The footrest assembly 200 is comprised of a plurality of links arranged to extend and collapse the ottoman (s) during adjustment of the lifter recliner between the extended position and the closed position, respectively. The seat-mounting plate 400 is configured to fixedly mount to the seat of the lifter recliner and, in conjunction with an opposed seat-mounting plate, defines a seat support surface (not shown). Generally, the seat-adjustment assembly 500 is adapted to recline and incline the backrest of the lifter recliner, which is coupled to a back-mounting link 510 of the seat-adjustment assembly 500. Further, the seat-adjustment assembly 500 includes links (e.g., motor swing bracket 470) that indirectly couple a front motor bracket 325 of the motor assembly 300 to the seat-mounting plate 400, thereby facilitating movement of the lifter-recliner seat upon actuation of the linear actuator.

Further, the linkage mechanism 100 comprises a plurality of linkages that are arranged to actuate and control movement of the lifter recliner during adjustment between the closed, the extended, and the reclined position. These linkages may be pivotably interconnected. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary as desired, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements (such as intervening elements) may also be present.

Generally, the linkage mechanism 100 guides the rotational movement of the backrest, the translation of the seat, and the extension of the ottoman(s). In an exemplary configuration, these movements are controlled by a pair of essentially mirror-image linkage mechanisms (one of which is shown herein and indicated by reference numeral 100), which comprise an arrangement of pivotably interconnected linkages. The linkage mechanisms are typically disposed in opposing-facing relation about a longitudinally-extending plane that bisects the lifter recliner between the pair of opposed arms. As such, the ensuing discussion will focus on only one of the linkage mechanisms 100, with the content being equally applied to the other, complimentary, linkage assembly.

With continued reference to FIG. 5, the support assembly 600 will now be discussed. Typically, the support assembly 600 serves as a foundation that rests on a surface underlying the lifter recliner. The support assembly 600 includes a front lateral member 610, a rear lateral member 620, a left longitudinal member 630, and a right longitudinal member 640. These members 610, 620, 630, and 640 may be formed from square metal tubing, or any other material used in the furniture-manufacturing industry that exhibits rigid properties. The front lateral member 610 and the rear lateral member 620 serve as crossbeams that span between and couple together the left longitudinal member 630 and the right longitudinal member 640. Further, the front lateral member 610 and the rear lateral member 620 are attached to a pair of lift pivot plates 740 (see FIG. 10), respectively, within the lift assemblies 700. As such, the support assembly 600 extends between and fixedly attaches the lift assemblies 700 in a parallel-spaced manner.

When constructed into the support assembly 600, the members 610 and 620 reside in substantial perpendicular relation with the members 630 and 640. In its role as a foundation, the support assembly 600 acts as a platform by which the lift assembly 700 may raise and tilt the lifter recliner with respect to the underlying surface. Further, as more fully discussed below, the linear actuator of the motor assembly 300 controls movement of the lift assembly 700, and is pivotably coupled to the rear lateral member 620 of the support assembly 600.

Figure 5:
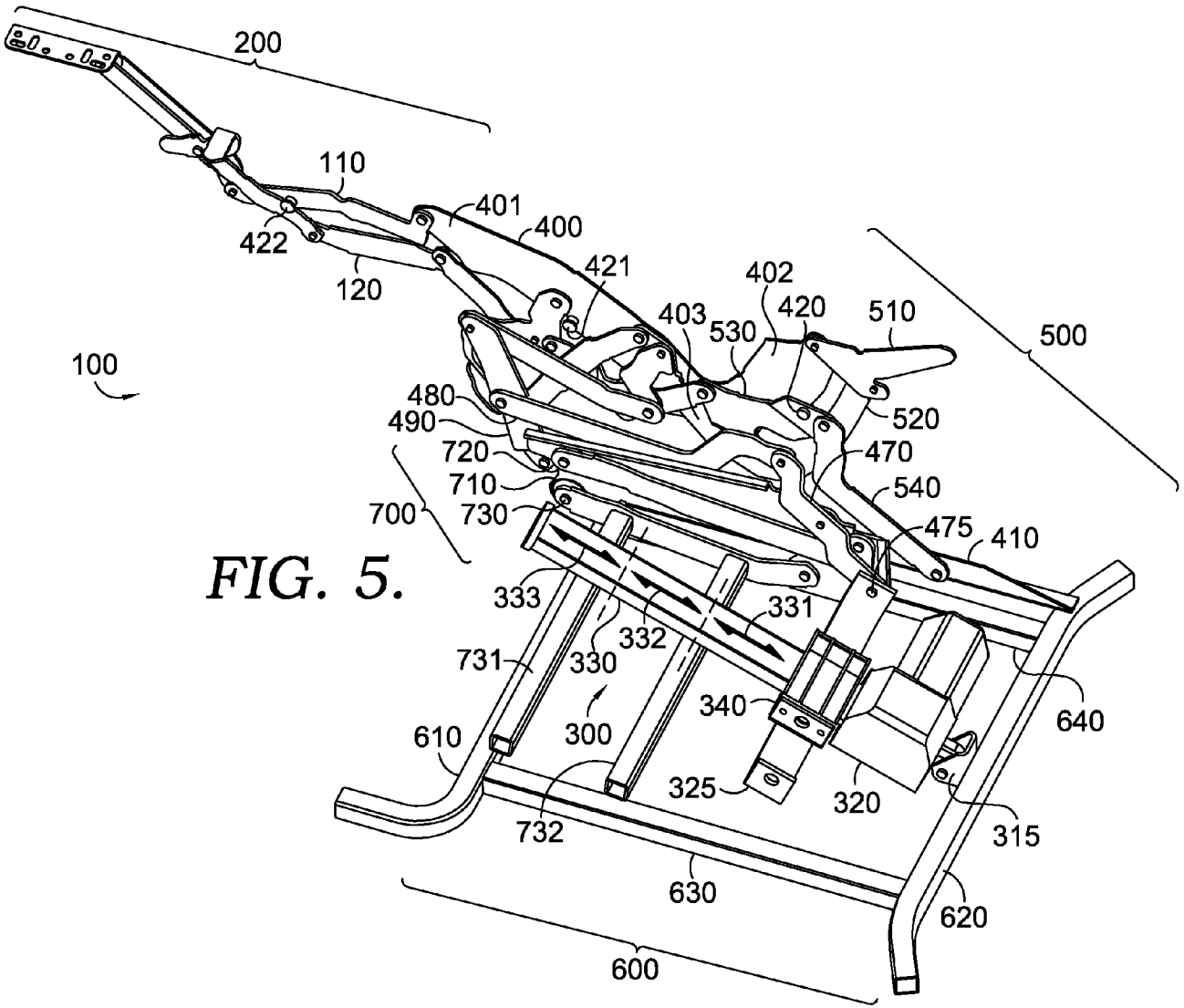
FIG. 5 is a perspective view of a linkage mechanism in the reclined position illustrating a linear actuator for providing motorized adjustment of the seating unit, in accordance with an embodiment of the present invention.
Figure 10:
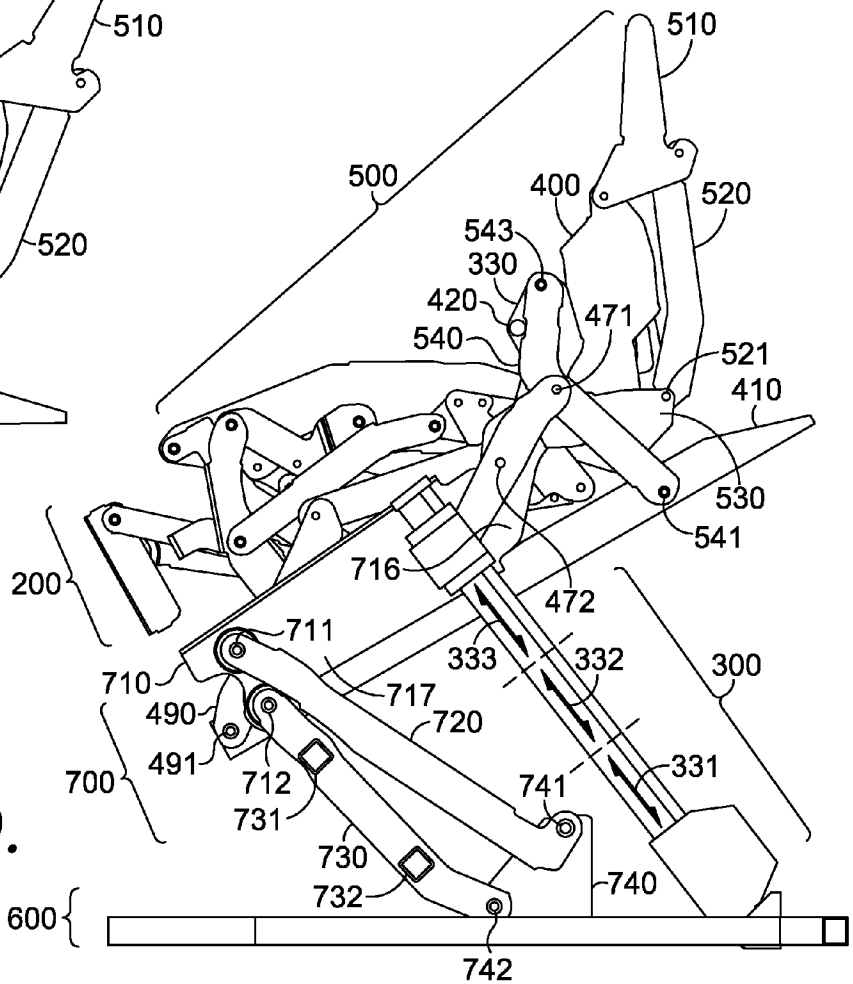
FIG. 10 is a view similar to FIG. 7, but in the seat-lift position, in accordance with an embodiment of the present invention.

Referring to FIGS. 5 and 10, an automated version of the lifter recliner, which utilizes a single linear actuator, is illustrated and will now be discussed via the embodiments below. In an exemplary embodiment, the linkage mechanism 100 and the support assembly 600 (discussed immediately above) are coupled to the linear actuator of the motor assembly 300, which provides powered adjustment of the linkage mechanism 100 between the reclined, the extended, and the closed positions. Further, the linear actuator is employed to provide powered adjustment of the lift assemblies 700 into and out of the seat-lift position, while holding the linkage mechanism in the closed position. The motor assembly 300 includes a rear motor bracket 315, a motor mechanism 320, a front motor bracket 325, a track 330, and a motor activator block 340. Typically, the motor mechanism 320 and the motor activator block 340 are slidably connected via the track 330.

This "linear actuator" comprised of the motor mechanism 320, the track 330, and the motor activator block 340 is held in position and coupled to the linkage mechanism 100 and the support assembly 600 by way of the front motor bracket 325 and the rear motor bracket 315, respectively. The motor mechanism 320 is protected by a housing that is pivotably coupled to the rear lateral member 620 of the support assembly 600 via the rear motor bracket 315. The motor activator block 340 is fixedly coupled to a front motor bracket 325 by way of fasteners, and is pivotably coupled to a motor swing bracket 470 of the seat-adjustment assembly 500 via the front motor bracket 325. In one configuration, the front motor bracket 325 includes a pair of opposed ends that attach to the pair of minor-image linkage mechanisms 100, respectively, while the motor activator block 340 is coupled to a section of the front motor bracket 325 located between the opposed ends.

Typically, the front motor bracket 325 spans between and couples together the linkage mechanism 100 shown in FIG. 5 and its counterpart, minor-image linkage mechanism (not shown). In embodiments, the front motor bracket 325 functions as a crossbeam and may be fabricated from metal stock (e.g., formed sheet metal). Similarly, a seat-mounting plate 400, a base plate 410, and a plurality of other links that comprise the linkage mechanism 100 may be formed from metal stock, such as stamped, formed steel. However, it should be understood and appreciated that any suitable rigid or sturdy material known in the furniture-manufacturing industry may be used in place of the materials described above.

In operation, the motor activator block 340 travels towards or away from the motor mechanism 320 along the track 330 during automated adjustment of the linear actuator. In a particular embodiment, the motor mechanism 320 causes the motor activator block 340 to longitudinally traverse, or slide, along the track 330 under automated control. This sliding action produces a lateral force on the front motor bracket 325, which, in turn, generates movement of the linkage mechanism 100 via the motor swing bracket 470. As more fully discussed below, the sliding action is sequenced into a first phase, a second phase, and a third phase. In an exemplary embodiment, the first phase, the second phase, and the third phase are mutually exclusive in stroke. In other words, the linear-actuator stroke of the first phase fully completes before the linear-actuator stroke of the second phase commences, and vice versa. Likewise, the linear-actuator stroke of the second phase fully completes before the linear-actuator stroke of the third phase commences, and vice versa.

Initially, the track 330 is operably coupled to the motor mechanism 320 and includes a first travel section 331, a second travel section 332, and a third travel section 333. The motor activator block 340 translates longitudinally along the track 330 under automated control of the motor mechanism 320 such that the motor activator block 340 translates within the first travel section 331 during the first phase, the second travel section 332 during the second phase, and the third travel section 333 during the third phase. As illustrated in FIG. 5, the dashed lines separating the first travel section 331, the second travel section 332, and the third travel section 333 indicate that the travel sections 331, 332, and 333 abut, however, they do not overlap. It should be realized that the precise lengths of the travel sections 331, 332, and 333 are provided for demonstrative purposes only, and that the length of the travel sections 331, 332, and 333, or ratio of the linear-actuator stroke allocated to each of the first phase, second phase, and third phase, may vary from the length or ratio depicted.

Generally, the first phase involves longitudinal translation of the motor activator block 340 along the first travel section 331 of the track 330, which creates a lateral thrust at the front motor bracket 325. The lateral thrust invokes first-phase movement of the motor swing bracket 470. This first-phase movement of the motor swing bracket 470 invokes and controls adjustment of the seat-adjustment assembly 500 between the extended position and the reclined position. Further, during the first phase, the motor activator block 340 moves forward and upward with respect to the support assembly 600, while the motor mechanism 320 remains generally fixed in space.

Once the stroke of the first phase is substantially complete, the second phase may occur. Generally, the second phase involves continued longitudinal translation of the motor activator block 340, but along the second travel section 332 of the track 330. This translation within the second travel section 332 generates a lateral thrust at the front motor bracket 325, thereby invoking second-phase movement of the motor swing bracket 470. The second-phase movement of the motor swing bracket 470 controls adjustment of (extends or retracts) the footrest assembly 200 between the closed position and the extended position. Typically, during the stroke of the linear actuator within the second phase, the motor activator block 340 again moves forward and upward with respect to the support assembly 600 while the motor mechanism 320 remains generally fixed in space.

Figure 12:
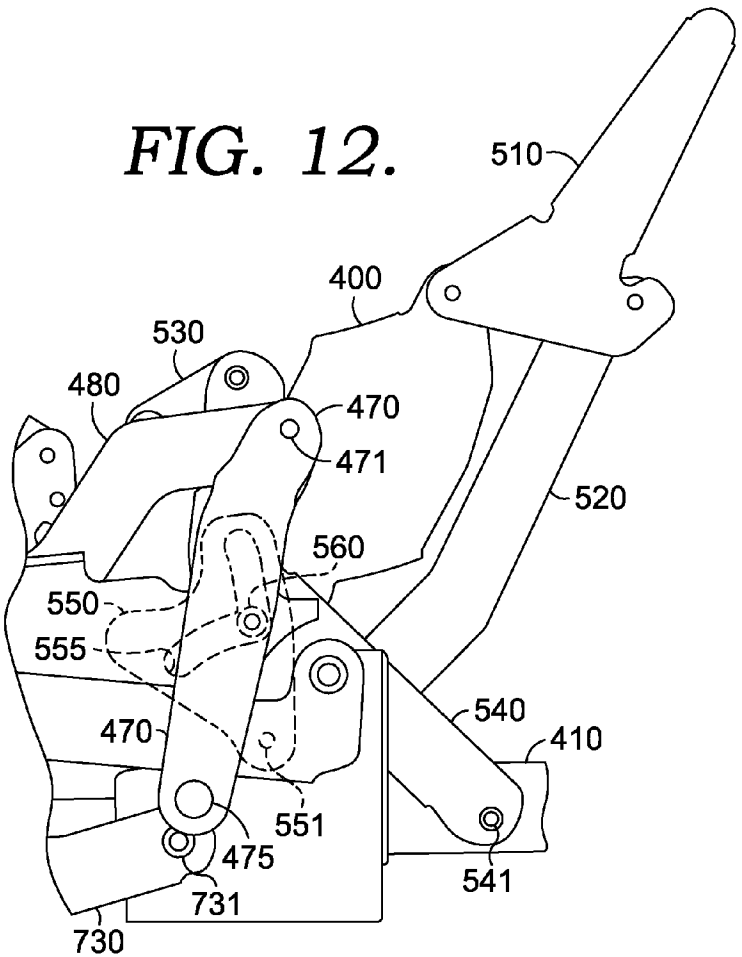
FIG. 12 is a view similar to FIG. 11, but in the extended position, in accordance with an embodiment of the present invention.
Figure 11:
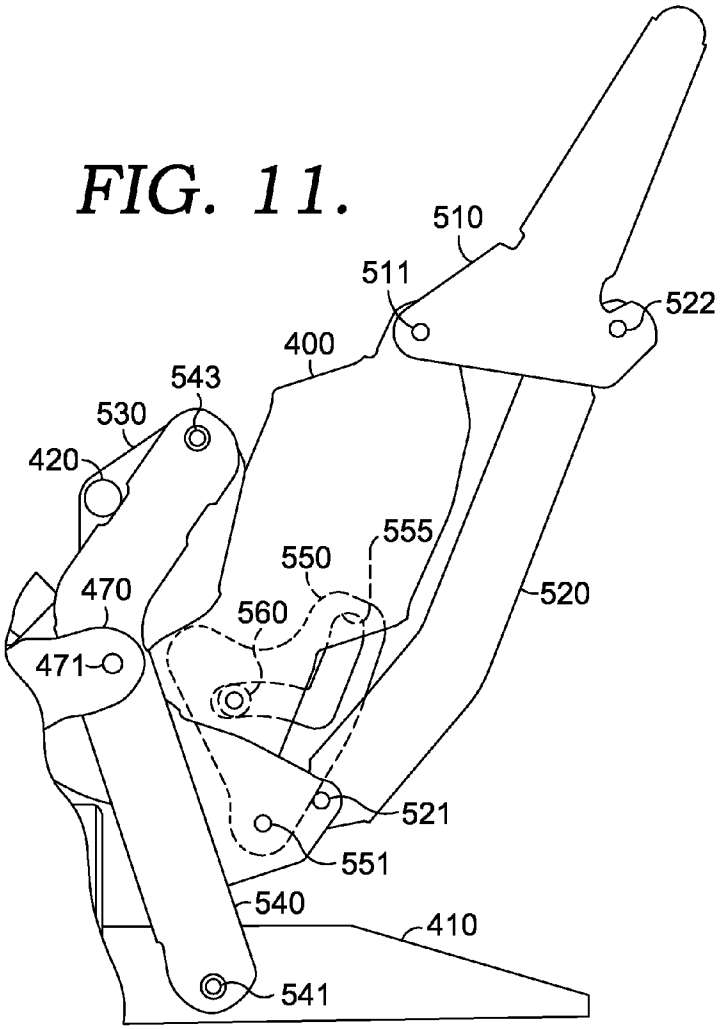
FIG. 11 is a partial side elevation view of the linkage mechanism in the closed position highlighting a sequence plate, in accordance with an embodiment of the present invention.
Figure 13:
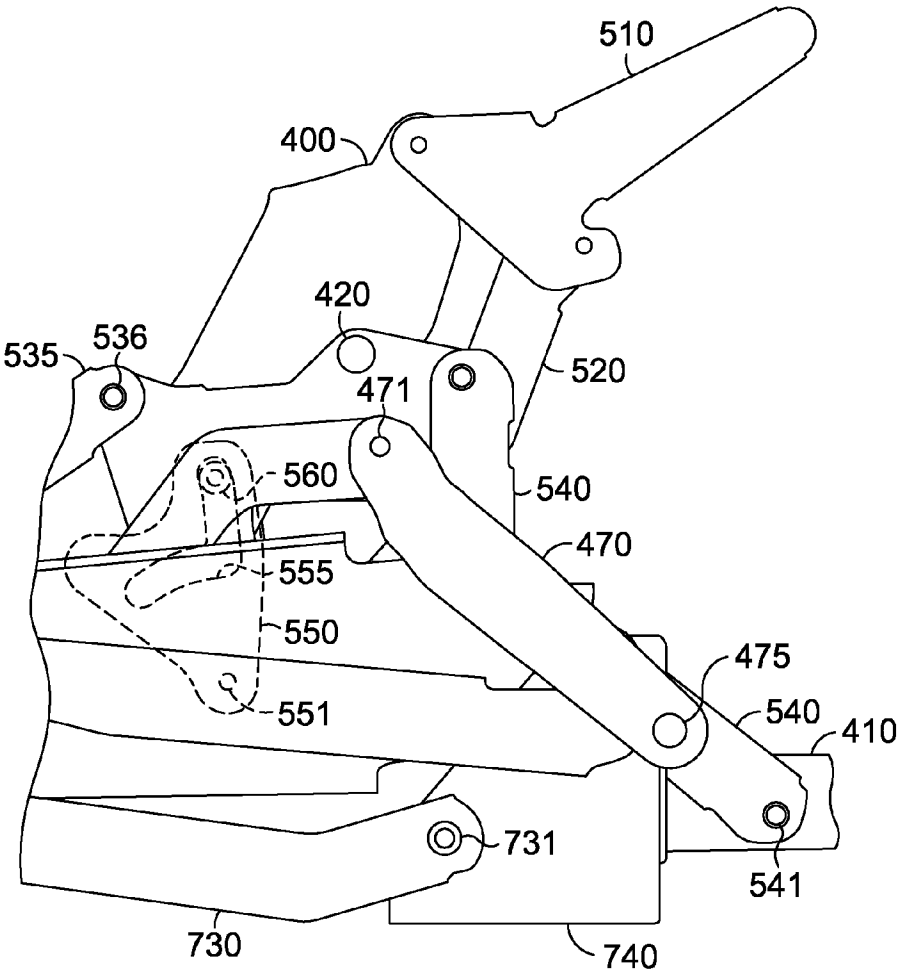
FIG. 13 is a view similar to FIG. 11, but in the reclined position, in accordance with an embodiment of the present invention.
Figure 14:
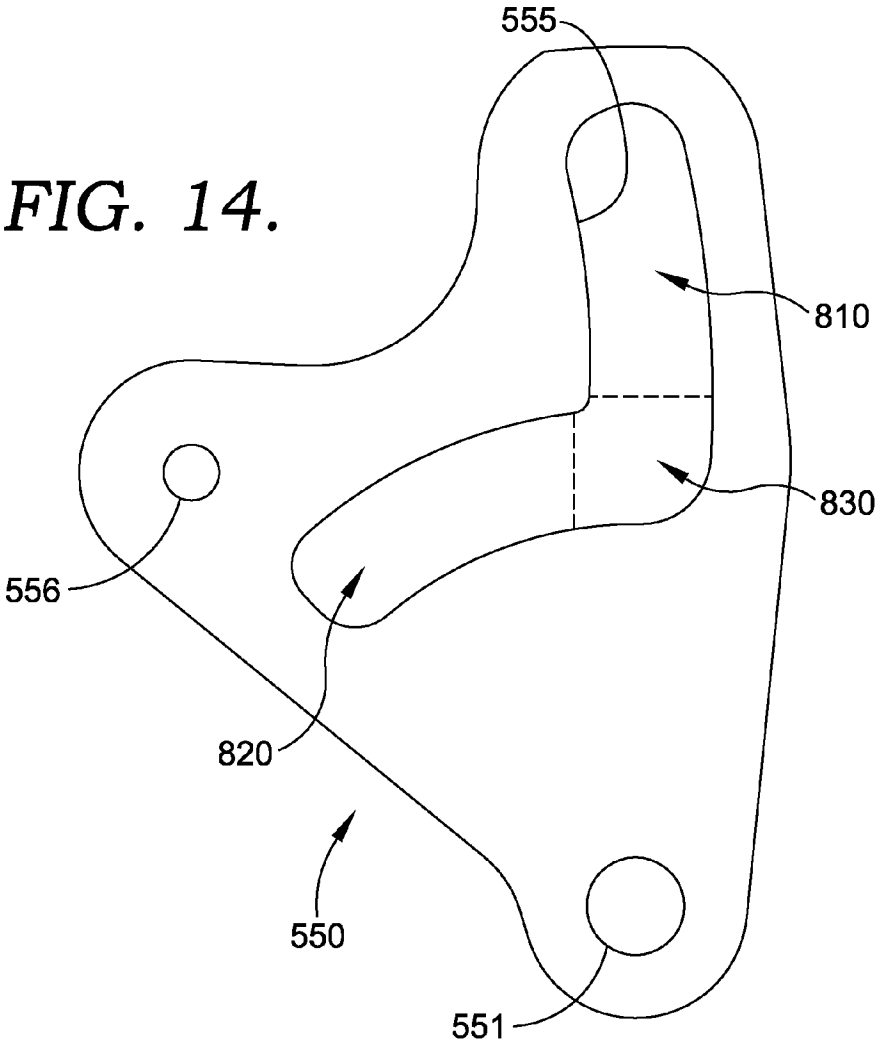
FIG. 14 is a diagrammatic lateral view of the sequence plate disassembled from the linkage mechanism, in accordance with an embodiment of the present invention.

In an exemplary embodiment, the first-phase movement includes a range of degrees of angular rotation of the motor swing bracket 470 that does not intersect a range of degrees included within the second-phase of movement. Further, the first and second phase may be sequenced into specific movements of the linkage mechanism 100. In embodiments, a weight of an occupant seated in the lifter recliner and/or springs interconnecting links of the seat-adjustment assembly 500 may assist in creating the sequence. Accordingly, the sequence ensures that adjustment of the footrest between the closed and extended positions is not interrupted by an adjustment of the backrest, and vice versa. In other embodiments, as depicted in FIGS. 11-13, a sequencing assembly integrated within the linkage mechanism 100 is provided to control the sequenced adjustment of the lifter recliner.

Once a stroke of the second phase is substantially complete, the third phase occurs. During the third phase, the motor activator block 340 longitudinally translates forward and upward along the third travel section 333 of the track 330 with respect to the motor mechanism 320, while the motor mechanism 320 remains generally fixed in space. This longitudinal translation of the motor activator block 340 along the third travel section 333 creates a lateral thrust at the motor swing bracket 470, but does not rotate the motor swing bracket 470 because one or more links of the linkage mechanism 100 has encountered one or more stop elements attached thereto, thus, securing the linkage mechanism 100 in a detent condition. Consequently, the lateral thrust at the front motor bracket 325 invokes adjustment of the lift assemblies 700 into or out of the seat-lift position while maintaining the pair of linkage mechanisms 100 in the closed position. That is, the stroke of the third phase raises and tilts forward the linkage mechanism 100, with respect to the support assembly 600, thus, adjusting the lift assembly 700 between a collapsed configuration and an expanded seat-lift position that facilitates entrance and exit to the lifter recliner.

In one instance, the combination of the motor mechanism 320, the track 330, and the motor activator block 340 is embodied as an electrically powered linear actuator. In this instance, the linear actuator is controlled by a hand-operated controller that provides instructions to the linear actuator. These instructions may be provided upon detecting a user-initiated actuation of the hand-operated controller. Further, these instructions may cause the linear actuator to carry out a compete first phase and/or second phase of movement. Or, the instructions may cause the linear actuator to partially complete the first phase or the second phase of movement. As such, the linear actuator may be capable of being moved to and maintained at various positions within a stroke of the first phase or the second phase, in an independent manner.

Although a particular configuration of the combination of the motor mechanism 320, the track 330, and the motor activator block 340 has been described, it should be understood and appreciated that other types of suitable devices that provide sequenced adjustment may be used, and that embodiments of the present invention are not limited to a linear actuator as described herein. For instance, the combination of the motor mechanism 320, the track 330, and the motor activator block 340 may be embodied as a telescoping apparatus that extends and retracts in a sequenced manner.

Turning to FIGS. 6-9, the components of the linkage mechanism 100 will now be discussed in detail. As discussed above, the linkage mechanism 100, which is raised and lowered by the lift assembly 700 (discussed below), includes the footrest assembly 200, the seat-mounting plate 400, the base plate 410, and the seat-adjustment assembly 500. The footrest assembly 200 includes a front ottoman link 110, a rear ottoman link 120, an outer ottoman link 130, a mid-ottoman bracket 140, an inner ottoman link 150, and a footrest bracket 170. Front ottoman link 110 is rotatably coupled to a forward portion 401 of the seat-mounting plate 400 at pivot 115. The front ottoman link 110 is also pivotably coupled to the outer ottoman link 130 at pivot 113 and the inner ottoman link 150 at pivot 117. Further, the front ottoman link 110 has a front stop element 422 fixedly attached at a mid section thereof that functions to resist continued extension of the footrest assembly 200 when the front stop element 422 contacts a side of the outer ottoman link 130.

Figure 6:
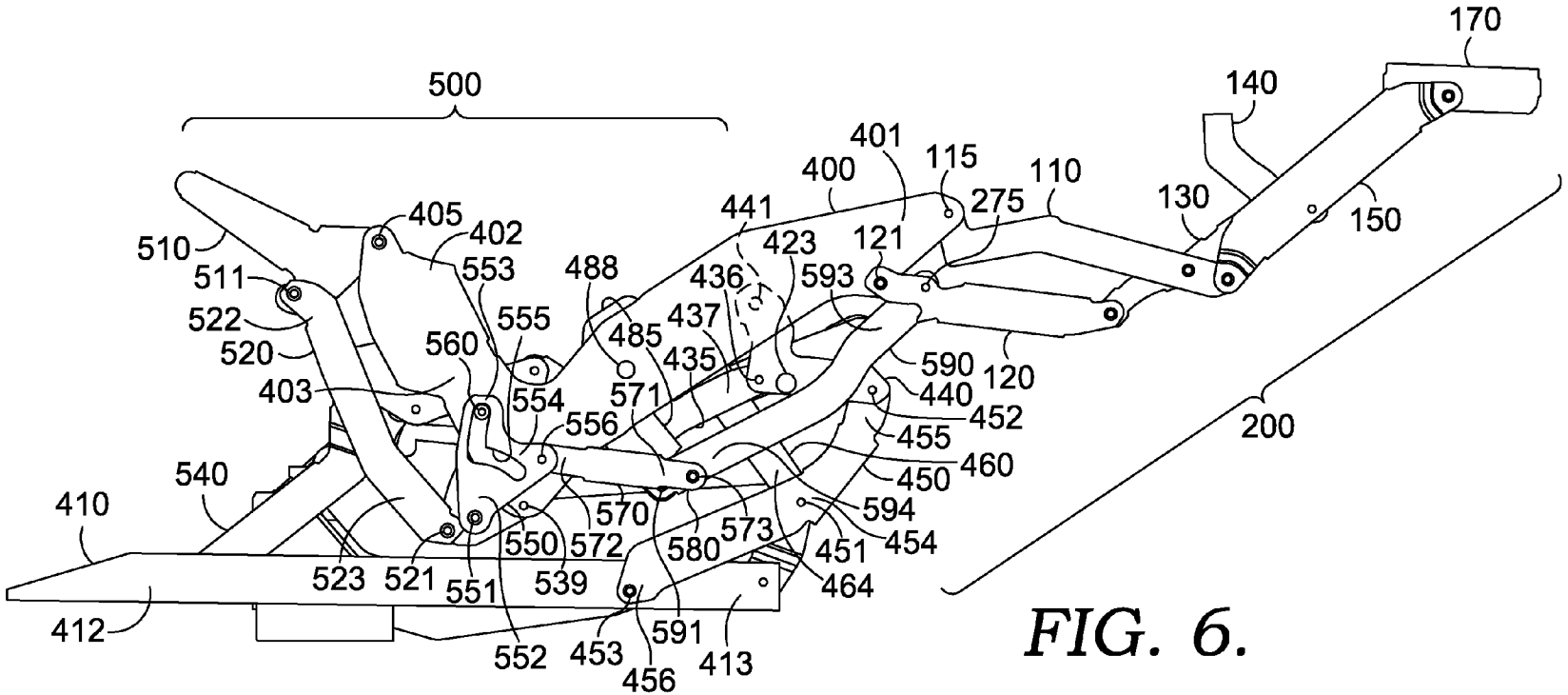
FIG. 6 is a diagrammatic lateral view of the linkage mechanism in the reclined position from a vantage point external to the seating unit, in accordance with an embodiment of the present invention.

Typically, the rear ottoman link 120 is rotatably coupled to the forward portion 401 of the seat-mounting plate 400 at pivot 121 and is pivotably coupled to the outer ottoman link 130 at pivot 133. Further, as shown in FIG. 6, the rear ottoman link 120 is pivotably coupled to a front end 593 of a footrest drive link 590 of the seat-adjustment assembly 500 at pivot 275. During adjustment in the second phase (i.e., adjustment between the closed and extended positions), directional force transferred by the linear actuator to the motor swing bracket 470 causes the footrest assembly 200 to extend to the extended position or to collapse to the closed position. In a specific configuration illustrated in FIGS. 6 and 7, the second-phase movement of the motor swing bracket 470 generates rotation of a seat-plate link 485 about pivot 488 that, in turn, invokes translation of the footrest drive link 590 through pivot 591. In addition, the rotation of a seat-plate link 485 about the pivot 488 invokes translation of a front sequence link 570 through pivot 573, which biases a sequence plate 550 either forward or rearward. As described more fully below, with reference to FIGS. 11-13, the forward and rearward biasing of the sequence plate 550 causes a sequence element 560 attached to the seat-mounting plate 400 to laterally shift locations within a guide slot 555 of the sequence plate 550.

Returning to the footrest assembly 220, the outer ottoman link 130 is pivotably coupled on one end to the rear ottoman link 120 at the pivot 133 and the front ottoman link 110 at the pivot 113. At an opposite end, the outer ottoman link 130 is pivotably coupled to the footrest bracket 170 at pivot 172. The mid-ottoman bracket 140 is pivotably coupled to a section between the ends of the outer ottoman link 130 at pivot 135. The mid-ottoman bracket 140 is also pivotably coupled to the inner ottoman link 150 at pivot 141. The inner ottoman link 150 is further pivotably coupled to the front ottoman link 110 at the pivot 117 and to the footrest bracket 170 at pivot 175. In embodiments, the footrest bracket 170 and the mid-ottoman bracket 140 are designed to attach to ottomans, such as the first foot-support ottoman 45 and the second foot-support ottoman 47, respectively. In a specific instance, as shown in FIG. 2, the footrest bracket 170 and the mid-ottoman bracket 140 support respective ottomans in a substantially horizontal disposition when the footrest assembly 200 is fully extended upon completion of the second phase of adjustment.

The seat-adjustment assembly 500 includes a front lift link 440, a front pivot link 450, a carrier link 460, the motor swing bracket 470, a motor drive link 480, a seat-plate link 485, a raise link 490, a front guide link 495, a back-mounting link 510, a rear pivot link 520, a rear bellcrank 530, a bridge link 535, a rear control link 540, the sequence plate 550 having the guide slot 555 formed therein, the sequence element 560 that travels within the guide slot 555, a front sequence link 570, and a footrest drive link 590. Initially, the motor swing bracket 470 includes a mid portion 477 located between a first (lower) end 478 and a second (upper) end 476. As discussed above, the motor activator block 340 fixedly attaches to the mid section of the front motor bracket 325, which is pivotably coupled at one of the opposed ends to the lower end 478 of the motor swing bracket 470 at pivot 475 (see FIG. 5). The upper end 476 of the motor swing bracket 470 is pivotably coupled to a back end 482 of the motor drive link 480 at pivot 471. In addition, the motor swing bracket 470 is rotatably coupled to a rearward portion 716 of a lift carrier plate 710 of the lift assembly 700 at pivot 472. The motor drive link 480 is pivotably coupled on the back end 482 to the motor swing bracket 470 at the pivot 471 and is pivotably coupled on a front end 481 to the raise link 490 at pivot 483.

In embodiments, the raise link 490 includes a mid portion 496 located between an upper end 497 and a lower end 498. The mid portion 496 of the raise link 490 is pivotably coupled to the front end 481 of the motor drive link 480 at the pivot 483. The upper end 497 of the raise link 490 is pivotably coupled to the front guide link 495 at pivot 491, while the lower end 498 is rotatably coupled to a forward portion 413 of the base plate 410 at pivot 492. The front guide link 495 is pivotably coupled on one end to the upper end 497 of the raise link 490 at the pivot 491, and is pivotably coupled at an opposite end to the seat-plate link 485 at pivot 486. The seat-plate link 485, which may be composed of a plurality of formed plates, is rotatably coupled at its mid portion to the seat-mounting plate 400 at pivot 488. Generally, the mid portion is located between two opposed ends of the seat-plate link 485. A first of the ends of the seat-plate link 485 is pivotably coupled to a back end 463 of the carrier link 460 at pivot 461. A second of the ends of the seat-plate link 485 is pivotably coupled to a back end 594 of the footrest drive link 590 at the pivot 591 and to a front end 571 of the front sequence link 570 at the pivot 573. As discussed above, a front end 593 of the footrest drive link 590 is pivotably coupled to the rear ottoman link 120 at the pivot 275. As more fully discussed below, the sequence plate 550 is pivotably coupled to a back end 572 of the front sequence link 570 at pivot 556.

The back end 463 of the carrier link 460 is pivotably coupled to the seat-plate link 485 at the pivot 461. A front end 464 of the carrier link 460 is pivotably coupled to a mid portion 454 of the front pivot link 450 at pivot 451. The front pivot link 450 includes the mid portion 454 located in between an upper end 455 and a lower end 456. The upper end 455 of the front pivot link 450 is pivotably coupled to the front lift link 440 at pivot 452. The lower end 456 of the front pivot link 450 is rotatably coupled to the forward portion 413 of the base plate 410 at pivot 453. The front lift link 440 is pivotably coupled to the upper end 455 of the front pivot link 450 at the pivot 452 and is rotatably coupled to the seat-mounting plate 400 at pivot 441. Also, the front lift link 440 is pivotably coupled to the bridge link 535 at pivot 436. Further, the front lift link 440 includes an exterior mid stop element 423 for ceasing extension of the footrest assembly 200 upon a side of the footrest drive link 590 making contact therewith.

The back-mounting link 510 is rotatably coupled to a rearward portion 402 of the seat-mounting plate 400 at pivot 405 and is pivotably coupled to an upper end 522 of the rear pivot link 520 at pivot 511. The rear pivot link 520 is pivotably coupled at the upper end 522 to the back-mounting link 510 at the pivot 511 and is pivotably coupled at a lower end 523 to the rear bellcrank 530 at pivot 521. The rear bellcrank 530 is pivotably coupled to the lower end 523 of the rear pivot link 520 at the pivot 521, the rear lift link 540 at pivot 543, and a back end 438 of the bridge link 535 at pivot 533. Also the rear bellcrank 530 is rotatably coupled to a mid portion 403 of the seat-mounting plate 400 at pivot 539. Further, the rear bellcrank 530 includes a rear stop element 420 extending therefrom that serves to prevent additional inclination of the back-mounting link 510 (completing adjustment to the closed position) when a side of the rear lift link 540 makes contact therewith. The bridge link 535 is pivotably coupled at its back end 438 to the rear bellcrank 530 at the pivot 533 and is pivotably coupled at the its front end 437 to the front lift link 440 at the pivot 436. The rear lift link 540 is pivotably coupled to the rear bellcrank 530 at the pivot 543 and to a rearward portion 412 of the base plate 410 at pivot 541.

The sequence plate 550 is rotatably coupled to the rear bellcrank 530 at the pivot 551. Also, the sequence plate 550 is pivotably coupled to the back end 572 of the front sequence link 570 at the pivot 556. As discussed above, front sequence link 570 is pivotably coupled at its back end 572 to the sequence plate 550 at the pivot 556 and is pivotably coupled at its front end 571 to the back end 594 of the footrest drive link 590 at the pivot 573. As also discussed above, the front end 593 of the footrest drive link 590 is pivotably coupled to the rear ottoman link 120 of the footrest assembly 200 at the pivot 275.

Turning to FIGS. 11-14, a configuration of the sequence plate 550, the sequence element 560, and the front sequence link 570 will now be discussed. Initially, the sequence plate 550 includes the guide slot 555, an aperture for receiving hardware to form pivot 551, and an aperture for receiving hardware to form pivot 556. The guide slot 555 may be machined or formed within the sequence plate 550 and includes a first region 810, a second region 820, and an intermediate region 830 that interconnects the first region 810 and the second region 820. In embodiments, the guide slot 555 is generally L-shaped and the first region 810 is substantially vertical while the second region 820 is substantially horizontal.

The sequence plate 550 is rotatably coupled to an exterior side of the rear bellcrank 530. In one instance, the rotatable coupling occurs at the pivot 551 located at a lower portion 552 of the sequence plate 550. The back end 572 of the front sequence link 570 is pivotably coupled to a forward portion 554 of the sequence plate 550 at the pivot 556. The front end 571 of the of the front sequence link 570 is pivotably coupled to the back end 594 (see FIG. 6) of the footrest drive link 590 at the pivot 573. As such, adjustment of the footrest drive link 590 between the closed position (see FIG. 11) and extended position (see FIG. 12) may, in turn, articulably actuate the front sequence link 570 laterally. This lateral actuation causes the sequence plate 550 to rotate forward and backward about the pivot 551. Consequently, the rotation of the sequence plate 550 changes a relative position of the sequence element 560 within the guide slot 555.

Typically, the sequence element 560 is configured as a bushing or cylindrically shaped element that can effortlessly ride or travel within the guide slot 555. The sequence element 560 is fixedly attached to the mid portion 403 of the seat-mounting plate 400 on the exterior side, which is the side opposed to the rear bellcrank 530. Generally, the sequence element 560, at least partially, extends into the guide slot 555. In a particular embodiment, the sequence element 560 fully extends through the guide slot 555 and includes a cap (not shown) that retains the sequence plate 550 onto the sequence element 560.

The interaction between the components 550, 560, and 570 will now be discussed. Initially, the sequence element 560 resides within the second region 820 when the lifter recliner is adjusted to the closed position (see FIG. 11). When captured within the second region 820 of the guide slot 555, the interaction between the sequence element 560 and walls of the sequence plate 550 prevents direct adjustment of the seating unit to the reclined position. However, when the seating unit is adjusted to the extended position (see FIG. 12), by forwardly actuating the front sequence link 570 as discussed above, the sequence element 560 is shifted to reside within the intermediate region 830, or elbow, of the guide slot 555. When residing in the intermediate region 830, the lifter recliner is free to be adjusted to either the closed position or the reclined position, as the guide slot 555 allows two-directions of movement of the sequence element 560 from the intermediate region 830.

The seating unit may then be adjusted from the extended position to the reclined position (see FIG. 13). This adjustment causes the seat-mounting plate 400 to raise and to shift the sequence element 560 upward to reside within the first region 810. When the sequence element 560 resides within the first region 810 of the guide slot 555, the interaction of the sequence element 560 and the sequence plate 550 resists direct adjustment of the lifter recliner to the closed position. Accordingly, the sequencing described above ensures that adjustment of the footrest assembly 200 between the closed and extended positions is not interrupted by rotational biasing of the backrest, or vice versa. In other embodiments, the weight of the occupant of the seating unit and/or springs interconnecting links of the seat-adjustment assembly 500 assist in creating or enhancing the sequencing.

With reference to FIGS. 5 and 10, the lift assembly 700 will now be discussed. The lift assembly 700 includes the lift carrier plate 710, an upper lift link 720, a lower lift link 730, and the lift pivot plate 740. The lift assembly 700 is fixedly attached to a minor-image lift assembly (not shown) via a front traverse beam 731 and a rear traverse beam 732. In embodiments, the front traverse beam 731 and the rear traverse beam 732 function as a set of crossbeams and may be formed from square metal tubing. Also, the lift assembly 700 (shown) is fixedly attached to the right longitudinal member 640 of the support assembly 600 via the lift pivot plate 740, while the mirror-image lift assembly (not shown) is fixedly attached to the left longitudinal member 630. Further, the lift carrier plate 710 is fixedly attached to the base plate 410 of the linkage mechanism 100.

Turning to FIG. 10, the internal connections of the lift assembly 700 will now be discussed. The lift carrier plate 710 includes a forward portion 717 and the rearward portion 716. The motor swing bracket 470 is rotatably coupled to the rearward portion 716 of the lift carrier plate 710, while both the upper lift link 720 and the lower lift link 730 are pivotably coupled to the forward portion 717 of the lift carrier plate 710 at pivots 711 and 712, respectively. Also, the upper lift link 720 and the lower lift link 730 are pivotably coupled to the lift pivot plate 740 at pivots 741 and 742, respectively. In operation, the lift links 720 and 730 are configured to swing in a generally parallel-spaced relation when the linear actuator adjusts the lifter recliner into and out of the seat-lift position. Further, the configuration of the lift links 720 and 730 allow the lift carrier plate 710 to move in a path that is upward and tilted forward when adjusting to the seat-lift position of FIG. 10. As discussed above, movement into and out of the seat-lift position occurs in the third phase of the linear-actuator stroke in which the motor activator block 340 longitudinally traverses the track 330 within the third travel section 333.

Figure 7:
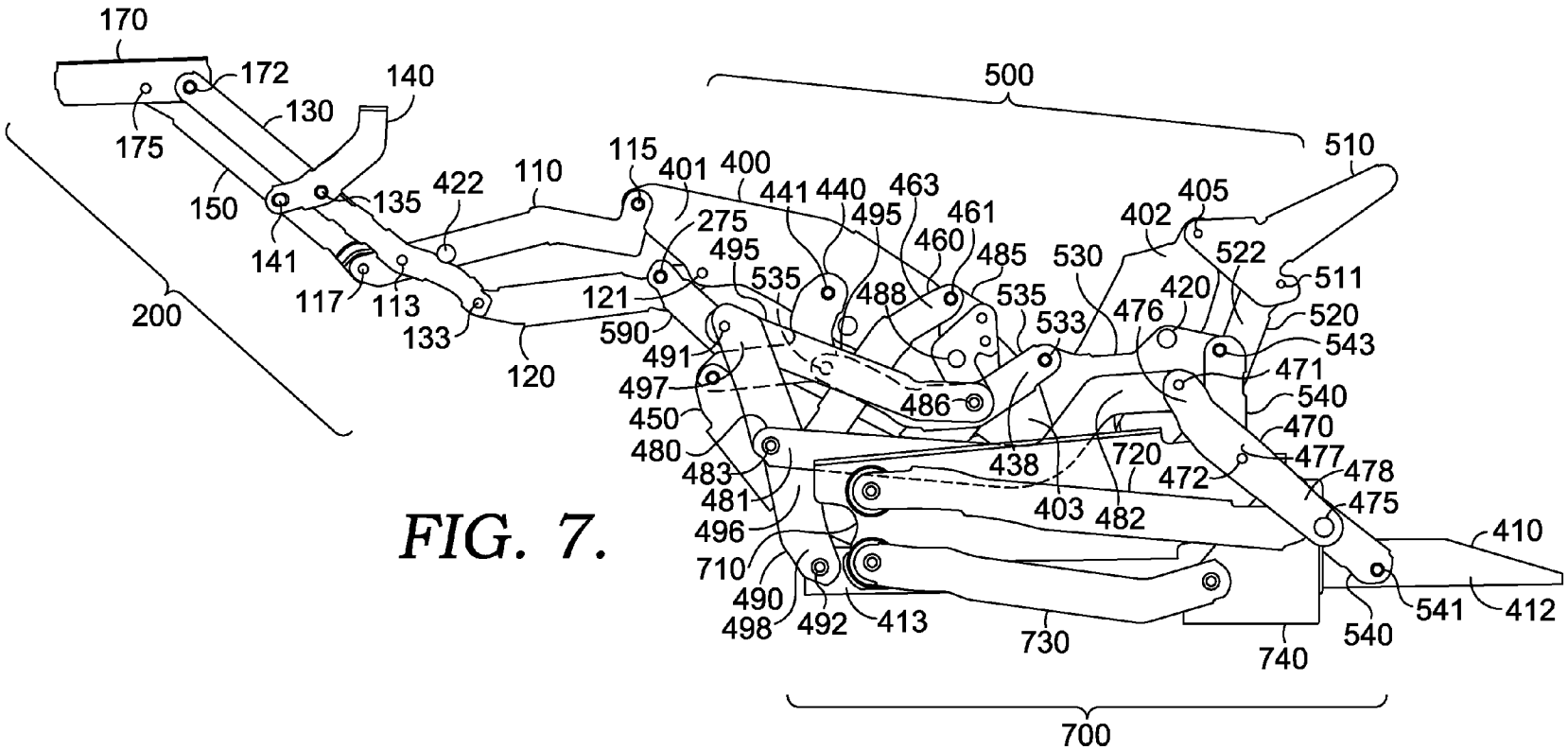
FIG. 7 is a diagrammatic lateral view of the linkage mechanism in the reclined position from a vantage point internal to the seating unit, in accordance with an embodiment of the present invention.
Figure 8:
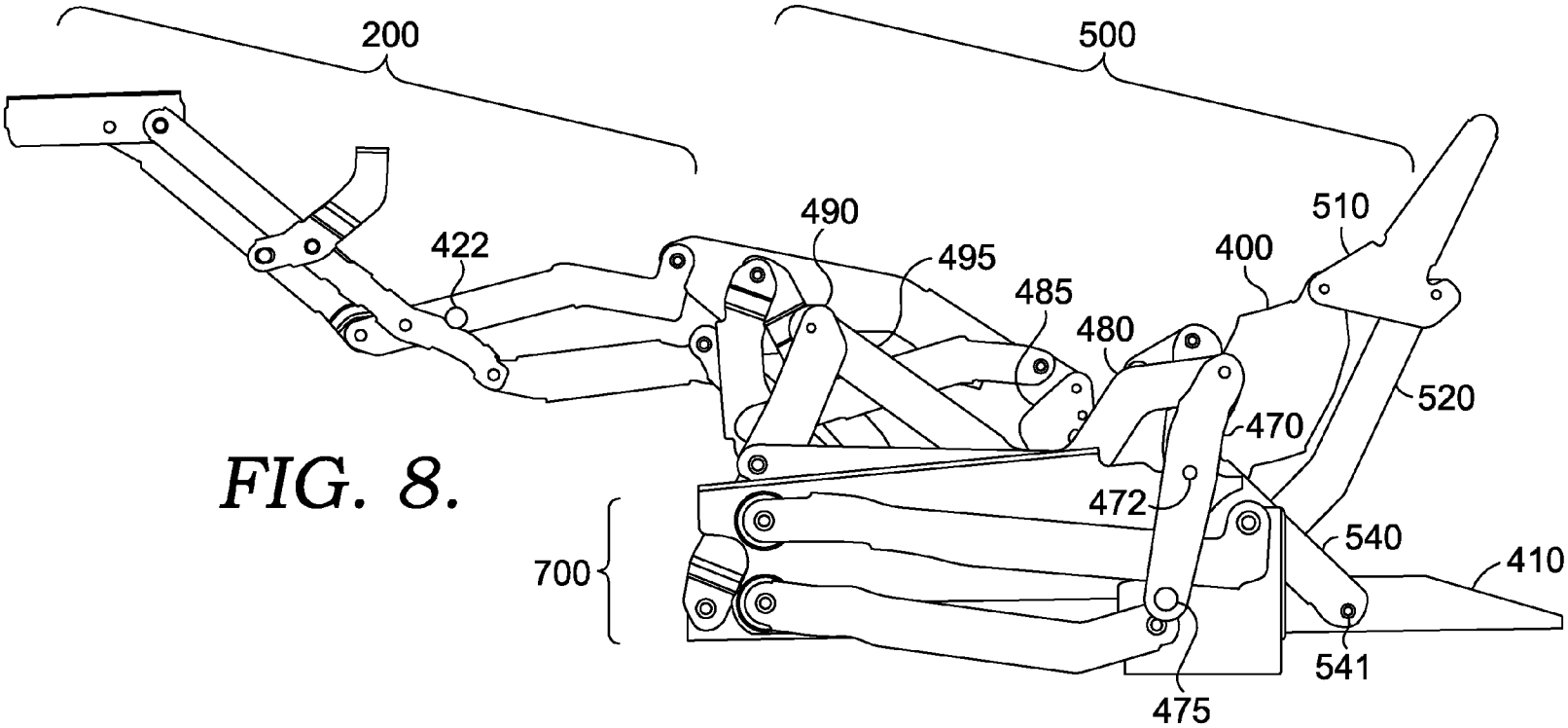
FIG. 8 is a view similar to FIG. 7, but in the extended position, in accordance with an embodiment of the present invention.

The operation of the seat-adjustment assembly 500 will now be discussed with reference to FIGS. 6-8. Initially, an occupant of the lifter recliner may invoke an adjustment from the reclined position (FIGS. 6 and 7) to the extended position (FIG. 8) in an effort to sit upright for viewing television. In an exemplary embodiment, the occupant may invoke an actuation at a hand-operated controller that sends a control signal with instructions to the linear actuator. As discussed above, the linear actuator moves in a sequenced manner, which is enforced by a weight of the occupant, a placement of springs within the seat-adjustment assembly 500, and/or a configuration of the sequence plate 550 and sequence element 560. Typically, the movement of the linear actuator is sequenced into three substantially independent strokes: the first phase (adjusting between the reclined and extended positions), the second phase (adjusting between the extended and closed positions), and the third phase (adjusting into and out of the seat-lift position (see FIG. 10) while the linkage mechanism 100 resides in the closed position).

Upon receiving the control signal from the hand-operated controller when the linkage mechanism 100 resides in the reclined position, the linear actuator carries out a stroke in the first phase. That is, with reference to FIG. 5, the linear actuator slides the motor activator block 340 forward with respect to the support assembly 600 while holding the motor mechanism 320 relatively fixed in space. This sliding action of the motor activator block 340 pushes the front motor bracket 325 forward that, in turn, invokes first-phase movement (angular rotation over a first range of degrees) at the motor swing bracket 470 about the pivot 472. This first-phase movement of the motor swing bracket 470 pulls the motor drive link 480 rearward a particular distance, which causes the raise link 490 to swing rearward about the pivot 492. The rearward swing of the raise link 490 pushes the front guide link 495 rearward, which rotates the seat-plate link 485 counterclockwise about the pivot 488, with reference to FIG. 7.

The counterclockwise rotation of the seat-plate link 485 pushes downward at the pivot 461, through the carrier link 460, and onto the pivot 451 at the mid portion 454 of the front pivot link 450. This downward push moves the seat-mounting plate 400 rearward with respect to the support assembly 600. Movement of the seat-mounting plate 400 in this rearward direction pulls the back-mounting link 510, along with the backrest, downward at the pivot 405 and causes the back-mounting link 510 to rotate forward about the pivot 511.

In addition, the rearward movement of the seat-mounting plate 400 pushes the front lift link 440 rearward such that a directional force is applied at the pivot 436, which transmits the directional force through the bridge link 535 onto the pivot 533 (coupling the bridge link 535 to the rear bellcrank 530). The rearward and downward directional force applied at the pivot 533 rotates the rear bellcrank 530 about the pivot 539 in a counterclockwise manner, with reference to FIG. 6. This counterclockwise rotation of the rear bellcrank 530 about the pivot 539 pulls the seat-mounting plate 400 downward and rearward at the pivot 543 (coupling the rear bellcrank 530 to the rear lift link 540). Eventually, the rotation of the rear bellcrank is ceased upon the linear actuator reaching the end of the first travel section 331. At this point, adjustment from the reclined position to the extended position is substantially complete.

Figure 9:
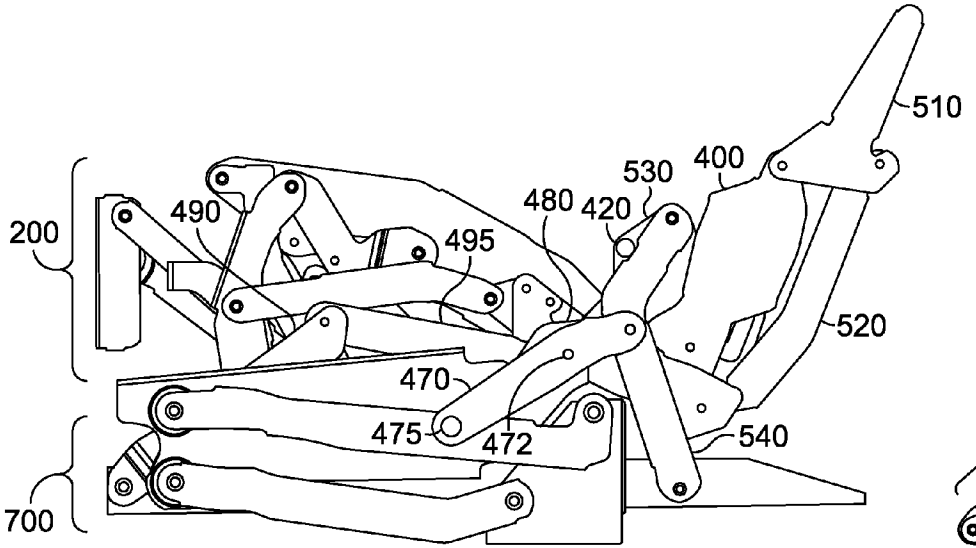
FIG. 9 is a view similar to FIG. 7, but in the closed position, in accordance with an embodiment of the present invention.

The operation of the footrest assembly 200 will now be discussed with reference to FIGS. 7-9. As discussed above, when desiring to move from the extended position (FIG. 8) to the closed position (FIG. 9), the occupant may invoke an actuation at the hand-operated controller that sends the control signal with instructions to the linear actuator to carry out a stroke in the second phase. Upon receiving the control signal from the hand-operated controller, the linear actuator slides the motor activator block 340 forward and upward with respect to the support assembly 600 while holding the motor mechanism 320 relatively fixed in space. This sliding action of the motor activator block 340 pushes the front motor bracket 325 forward that, in turn, invokes second-phase movement (angular rotation over a second range of degrees) at the motor swing bracket 470 about the pivot 472. This second-phase movement of the motor swing bracket 470 pulls the motor drive link 480 rearward an additional distance beyond the particular distance that was achieved during the first-phase movement. The second-phase movement also causes the raise link 490 to swing farther rearward about the pivot 492. The rearward swing of the raise link 490 again pushes the front guide link 495 rearward, which further rotates the seat-plate link 485 counterclockwise about the pivot 488, with reference to FIGS. 8 and 9.

The counterclockwise rotation of the seat-plate link 485 causes a rearward translation of the footrest drive link 590. This rearward translation of the footrest drive link 590 pulls the rear ottoman link 120 downward at the pivot 275 and rotates the rear ottoman link 120 downward about the pivot 121. The rear ottoman link's 120 downward rotation about the pivot 121 produces a downward and rearward force on the outer ottoman link 130 and, indirectly, the other links 110, 130, and 150, which pulls them toward the support assembly 600. In one instance, this downward and rearward force on the rear ottoman link 120 removes the front ottoman link 110 from contact with a front stop element 422, which serves to limit the extension of the footrest assembly 200. Also, similar to the adjustment in the first phase, the second-phase movement of the motor swing bracket 470 generates counterclockwise rotation of the rear bellcrank 530. Eventually, the counterclockwise rotation of the rear bellcrank 530 is resisted upon a side of the rear left link 540 contacting the rear stop element 420 extending from the rear bellcrank 530. At this point, adjustment from the extended position to the closed position is substantially complete.

In a manner that is reverse to the steps discussed above, with reference to operation of the footrest assembly 200 from the closed position to the extended position, the automated force of the linear actuator on the motor swing bracket 470 in the first phase of the linear-actuator stroke forces the footrest drive link 590 forward, which, in turn, rotates the rear ottoman link 120 about the pivot 121. This rotation acts to extend the footrest assembly 200 and causes the other links 110, 130, and 150 to move upwardly and/or rotate in a clockwise direction, with reference to FIG. 7. Also, the brackets 140 and 170 are raised and rotated in a clockwise fashion such that the ottomans 45 and 47 (see FIGS. 1-3) are adjusted from a collapsed, generally vertical orientation to an extended, generally horizontal orientation. Extension of the footrest assembly is restrained upon the front ottoman link 110 coming into contact with the front stop element 422.

In addition, upon completion of the second phase, continued actuation of the linear actuator causes the adjustment of the linkage mechanism 100 within the first phase of the linear-actuator stroke. Within the first phase, the automated force of the motor activator block 340 on the front motor bracket 325 rotates the lower end 478 of the motor swing bracket 470 rearward about the pivot 472, which acts to translate forward the seat-mounting plate 400 and, in turn, bias rearward the back-mounting link 510 about the pivot 511. The rearward bias of the back-mounting link 510, as well as continued adjustment within the first phase, is restrained upon the completion of the translation of the motor activator block 340 within the first travel section 331.

It should be understood that the construction of the linkage mechanism 100 lends itself to enable the various links and brackets to be easily assembled and disassembled from the remaining components of the seating unit. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A seating unit having a chassis, a seat, a backrest, and at least one foot-support ottoman, the seating unit being adapted to move between a closed, an extended, a reclined, and a seat-lift position, the seating unit comprising:

a pair of base plates in substantially parallel-spaced relation;

a pair of lift assemblies, wherein each of the lift assemblies is attached to a respective base plate and raises and lowers the respective base plate above an underlying surface;

a pair of seat-mounting plates in substantially parallel-spaced relation, wherein the seat-mounting plates translatably carry the seat over the lift assemblies; and a pair of generally mirror-image linkage mechanisms each moveably interconnecting each of the base plates to a respective seat-mounting plate, wherein each of the linkage mechanisms comprise:

(a) a footrest assembly that extends and retracts the at least one foot-support ottoman; and (b) a seat-adjustment assembly that reclines and inclines the backrest;

a linear actuator that provides automated adjustment of the seating unit between the closed position, the extended position, the reclined position, and the seat-lift position, wherein the linear actuator comprises:

(a) a motor mechanism;

(b) a track operably coupled to the motor mechanism; and (c) a motor activator block that translates longitudinally along the track under automated control, wherein the linear-actuator adjustment is sequenced into a first phase, a second phase, and a third phase that are mutually exclusive in stroke, wherein the first phase moves the footrest assembly between the reclined position and the extended position, wherein the second phase moves the seat-adjustment assembly between the extended position and the closed position; and wherein the third phase moves the pair of lift assemblies into and out of the seat-lift position while maintaining the pair of linkage mechanisms in the closed position; and a front motor bracket that spans between and couples to the pair of linkage mechanisms, wherein the front motor bracket has a pair of ends, and wherein the motor activator block is fixedly coupled to a section between the pair of ends of the front motor bracket.

2. The seating unit of claim 1, wherein the track includes a first travel section, a second travel section, and a third travel section.

3. The seating unit of claim 2, wherein one of the ends of the front motor bracket is fixedly coupled to a motor swing bracket within the seat-adjustment assembly, and wherein the motor swing bracket is rotatably coupled to a rearward portion of a lift carrier plate within a respective lift assembly.

4. The seating unit of claim 3, further comprising a support assembly that spans between and couples to the pair of lift assemblies, wherein a housing of the motor mechanism is pivotably coupled to a rear lateral member of the support assembly.

5. The seating unit of claim 4, wherein the first phase involves longitudinal translation of the motor activator block along the first travel section that creates a lateral thrust at the front motor bracket, thereby invoking first-phase movement of the motor swing bracket, the first-phase movement of the motor swing bracket controls adjustment of the seat-adjustment assembly between the reclined position and the extended position.

6. The seating unit of claim 5, wherein, during the stroke of the linear actuator within the first phase, the motor activator block moves forward and upward with respect to the support assembly while the motor mechanism remains generally fixed in space.

7. The seating unit of claim 6, wherein the seat-adjustment assembly comprises:

the motor swing bracket that includes a mid portion located between a first end and a second end, wherein the mid portion of the motor swing bracket is rotatably coupled to the lift carrier plate, and wherein the first end of the motor swing bracket is pivotably coupled to a respective end of the front motor bracket;

a motor drive link that includes a front end and a back end, wherein the second end of the motor swing bracket is pivotably coupled to the back end of the motor drive link; and a raise link that includes a mid portion located between an upper end and a lower end, wherein the mid portion of the raise link is pivotably coupled to the front end of the motor drive link, and wherein the lower end of the raise link is rotatably coupled to a forward section of a respective base plate.

8. The seating unit of claim 7, wherein the second phase involves longitudinal translation of the motor activator block along the second travel section that creates a lateral thrust at the front motor bracket, thereby invoking second-phase movement of the motor swing bracket, the second-phase movement of the motor swing bracket controls adjustment of the footrest assembly between the closed position and the extended position, wherein the first-phase movement includes a range of degrees of angular rotation of the motor swing bracket that does not intersect a range of degrees included within the second-phase of movement.

9. The seating unit of claim 8, wherein, during the stroke of the linear actuator within the second phase, the motor activator block moves forward and upward with respect to the support assembly while the motor mechanism remains generally fixed in space.

10. The seating unit of claim 9, wherein each of the lift assemblies further comprise:

the lift carrier plate that includes a forward portion and the rearward portion;

a lift pivot plate that is attached to a longitudinal member of the support assembly;

an upper lift link that is pivotably coupled at one end to the forward portion of the lift carrier plate and is rotatably coupled at another end to the lift pivot plate; and a lower lift link that is pivotably coupled at one end to the forward portion of the lift carrier plate and is rotatably coupled at another end to the lift pivot plate.

11. The seating unit of claim 10, wherein the third phase involves longitudinal translation of the motor activator block along the third travel section that creates a lateral thrust at the front motor bracket, thereby invoking adjustment of the lift assemblies into or out of the seat-lift position while maintaining the pair of linkage mechanisms in the closed position.

12. The seating unit of claim 11, wherein, during the stroke of the linear actuator within the third phase, when adjusting the lift assemblies into the seat-lift position, the motor activator block moves forward and upward with respect to the support assembly while the motor mechanism remains generally fixed in space.

13. A seating unit, comprising:

a support assembly that contacts an underlying surface;

a pair of base plates in substantially parallel-spaced relation;

a pair of lift assemblies, wherein each of the lift assemblies is attached to a respective base plate and moveably supports the respective base plate with respect to the support assembly, wherein the lift assemblies are adapted to adjust the seating unit into and out of a seat-lift position;

a pair of seat-mounting plates in substantially parallel-spaced relation, wherein each of the seat-mounting plates is disposed in an inclined orientation in relation to each of the base plates, respectively; and a pair of generally mirror-image linkage mechanisms each moveably interconnecting each of the seat-mounting plates to a respective base plate, and adapted to move the seating unit between a closed position, an extended position, and a reclined position, wherein each of the linkage mechanisms comprise:

(a) a back-mounting link rotatably coupled to a respective seat-mounting plate and configured to support a backrest of the seating unit;

(b) a rear bellcrank rotatably coupled to a respective seat-mounting plate;

(c) a sequence plate rotatably coupled to the rear bellcrank, wherein the sequence plate includes a guide slot;

(d) a rear pivot link pivotably coupled to the back-mounting link and to the rear bellcrank; and (e) a sequence element that extends from a respective seat-mounting plate, wherein the sequence element, at least partially, extends into the guide slot, and wherein interaction between the sequence element and the sequence plate resists direct adjustment between the closed position and the reclined position.

14. The seating unit of claim 13, further comprising a rear control link that is pivotably coupled at one end to the rear bellcrank and at another end to a respective base plate.

15. A seating unit having a chassis, a seat, a backrest, and at least one foot-support ottoman, the seating unit being adapted to move between a closed, an extended, a reclined, and a seat-lift position, the seating unit comprising:

a pair of base plates in substantially parallel-spaced relation;

a pair of lift assemblies, wherein each of the lift assemblies is attached to a respective base plate and raises and lowers the respective base plate above an underlying surface;

a pair of seat-mounting plates in substantially parallel-spaced relation, wherein the seat-mounting plates translatably carry the seat over the lift assemblies;

a pair of generally mirror-image linkage mechanisms each moveably interconnecting each of the base plates to a respective seat-mounting plate, wherein each of the linkage mechanisms comprise:

(a) a footrest assembly that extends and retracts the at least one foot-support ottoman; and (b) a seat-adjustment assembly that reclines and inclines the backrest, wherein the seat-adjustment assembly comprises:

(i) a motor swing bracket that includes a mid portion located between a first end and a second end, wherein the mid portion of the motor swing bracket is rotatably coupled to a lift carrier plate within a respective lift assembly, wherein the first end of the motor swing bracket is pivotably coupled to a respective end of a front motor bracket, and wherein the front motor bracket is pivotably coupled to a motor activator block;

(ii) a motor drive link that includes a front end and a back end, wherein the second end of the motor swing bracket is pivotably coupled to the back end of the motor drive link; and (iii) a raise link that includes a mid portion located between an upper end and a lower end, wherein the mid portion of the raise link is pivotably coupled to the front end of the motor drive link, and wherein the lower end of the raise link is rotatably coupled to a forward section of a respective base plate; and a linear actuator that provides automated adjustment of the seating unit between the closed position, the extended position, the reclined position, and the seat-lift position, wherein the linear actuator comprises:

(a) a motor mechanism;

(b) a track operably coupled to the motor mechanism; and (c) the motor activator block that translates longitudinally along the track under automated control, wherein the linear-actuator adjustment is sequenced into a first phase, a second phase, and a third phase that are mutually exclusive in stroke, wherein the first phase moves the footrest assembly between the reclined position and the extended position, wherein the second phase moves the seat-adjustment assembly between the extended position and the closed position; and wherein the third phase moves the pair of lift assemblies into and out of the seat-lift position while maintaining the pair of linkage mechanisms in the closed position.

16. The seating unit of claim 15, wherein the front motor bracket has a pair of ends, wherein one of the ends of the front motor bracket is fixedly coupled to the motor swing bracket within the seat-adjustment assembly.

17. The seating unit of claim 15, further comprising a support assembly that spans between and couples to the pair of lift assemblies, wherein a housing of the motor mechanism is pivotably coupled to a rear lateral member of the support assembly.

* * * * *